United States Patent [19]

Flannery et al.

[11] Patent Number: 4,883,329

[45] Date of Patent: Nov. 28, 1989

[54] ASBESTOS CONTAINMENT BAG WITH SLIDE FASTENER CLOSURE

[75] Inventors: Gene Flannery, Thomasville; T. Blair Crouse, Lexington; Wesley L. Patterson, Thomasville, all of N.C.

[73] Assignees: Abatement Technologies, Inc., Duluth, Ga.; CPP, Inc., Thomasville, N.C.

[21] Appl. No.: 257,711

[22] Filed: Oct. 14, 1988

[51] Int. Cl.[4] ..... A61G 11/00

[52] U.S. Cl. ..... 312/1; 312/3; 383/64

[58] Field of Search ..... 312/1, 3, 5, 6, 283; 280/770; 224/42.42, 42.45 R, 42.46 R; 15/227, 345; 134/6, 10, 21, 42; 138/97; 383/64

[56] References Cited

U.S. PATENT DOCUMENTS

| | | | |
|---|---|---|---|
| 2,613,421 | 10/1952 | Madsen | 383/64 X |
| 3,051,164 | 8/1962 | Trexler . | |
| 3,802,416 | 4/1974 | Cazalis . | |
| 4,108,509 | 8/1978 | Piet et al. | 312/1 |
| 4,335,712 | 6/1982 | Trexler . | |
| 4,626,291 | 12/1986 | Natale | 134/21 |
| 4,746,175 | 5/1988 | Hamlet et al. | 312/3 X |

FOREIGN PATENT DOCUMENTS

| | | | |
|---|---|---|---|
| 569649 | 1/1959 | Canada . | |
| 1188191 | 6/1985 | Canada | 312/1 |
| WO88/04978 | 7/1988 | PCT Int'l Appl. | 312/1 |
| 1567270 | 5/1980 | United Kingdom . | |

OTHER PUBLICATIONS

Guidance for Controlling Friable Asbestos-Containing Materials in Buildings, 560-5-83-002, *EPA Report*, 3-22, (3/1983).

Guidance for Controlling Asbestos-Containing Materials in Buildings, 560-5-85-024, *EPA Report*, 5-8, (6/1985).

Package insert for Hands in Bag TM, Model No. 1001, manufactured by J. V. Manufacturing Co., of De Pere, Wisconsin.

Bulletin GG102, for "Glove Bag", manufactured by Instruments for Research and Industry of Cheltenham, Pa.

*Primary Examiner*—Joseph Falk

*Attorney, Agent, or Firm*—Kilpatrick & Cody

[57] ABSTRACT

An improved disposable containment bag for use in handling hazardous materials such as asbestos. A gusset and slide fastener assembly inside the bag permits the lower, waste-receiving compartment within the bag to be sealed, unsealed and resealed and facilitates accommodation of a large volume of waste.

5 Claims, 1 Drawing Sheet

ASBESTOS CONTAINMENT BAG WITH SLIDE FASTENER CLOSURE

This invention relates to a containment bag for use in the removal of hazardous waste materials from pipes.

BACKGROUND OF THE INVENTION

Asbestos is a naturally occurring, fibrous form of magnesium and calcium silicate ore.

Because of their microscopic size, billions of asbestos fibers can be released into the air during use or removal of construction materials containing asbestos. The asbestos fibers remain airborne and can contaminate inadequately protected workers.

Release of the fibers depends on how friable a particular asbestos-containing product may be. More friable products are easily crumbled and through use or deterioration can release fibers into the air. The types of asbestos products found in commercial and residential buildings often tend to be the most friable kind. Other types of less friable asbestos products can present a hazard if broken, crushed, sanded or otherwise damaged during construction, renovation or demolition.

Although generally banned in the United States in 1975, pipe coverings containing friable asbestos are still present in many buildings. Often containing more than fifty percent asbestos, the pipe coverings were usually manufactured in three-foot half sections and bound together over straight pipe sections. Wet applications of asbestos pipe coverings were applied over more irregular pieces of pipe. Renovation, deterioration and damage to the pipe insulation can release the asbestos fibers into the air. Furthermore, it is frequently desirable to remove asbestos pipe coverings in order to eliminate the hazards associated with the presence of such coverings.

As early as 1983, the Environmental Protection Agency ("EPA") suggested using plastic bags with armholes to isolate and remove asbestos from pipes. In 1985, the EPA issued "Guidance for Controlling Asbestos-Containing Materials in Buildings," EPA 560 (1985), which noted the commercial availability and desirability of using containment bags with internal tool pouches and armholes. Thus, it is known in the art that portable containment bags are useful in the asbestos abatement industry. Available containment bags have remained difficult to use, however, particularly when the bag has been filled with asbestos material and needs to be moved on or removed from the pipe.

SUMMARY OF THE INVENTION

An improved containment bag having glove access ports may be fabricated by use of a slide fastener mounted on gussets to close asbestos materials in the lower portion of the bag. Loops provided near bag "arm-holes" conveniently hold in place straps for cinching the bag snugly around the pipe, and use of sloping seal lines to affix the tool sleeve permits the sleeve to drain water and waste.

It is therefore a object of this invention to provide a disposable hazardous waste containment bag which provides advances in efficiency and safety over previous forms.

It is another object of this invention to provide an inexpensive containment bag and procedure for removing asbestos materials from pipes.

It is yet another object of this invention to provide an asbestos containment bag using a gusset-mounted slide fastener to increase work space and to reduce significantly the possibility of accidental aeration of asbestos fibers during abatement procedures.

The accomplishment of the of the foregoing objects and others, along with the features and advantages of the invention, will be readily apparent from the following detailed description, drawings and appended claims.

DETAILED DESCRIPTION OF THE INVENTION

Figure 1:
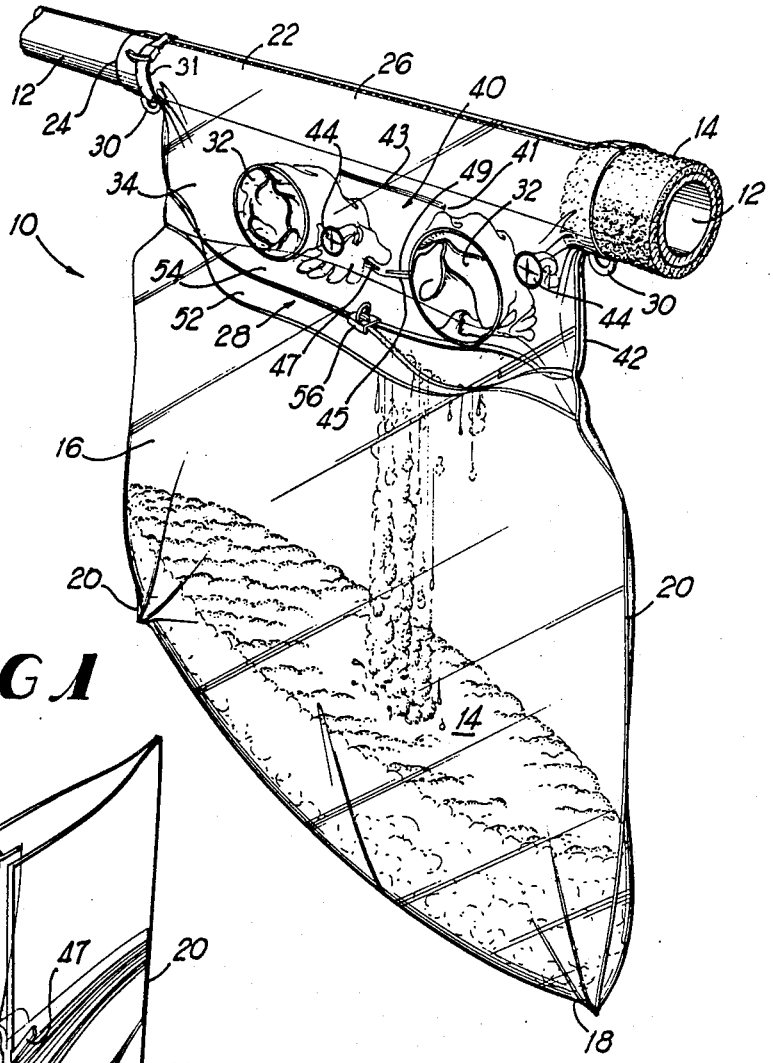
FIG. 1 is a perspective view of the containment bag of the present invention installed on a pipe from which some asbestos material has been removed and permitted to drop into the bag.

FIG. 1 depicts the containment bag 10 of the present invention in place on an asbestos covered pipe 12 which has been partially stripped of asbestos 14. The bag 10 consists of a generally rectangular flexible plastic sheet 16 folded along a line 18 which becomes its bottom edge, dielectrically sealed along side edges 20 and left unsealed among its top 22 and the upper portions 24 of side edges 20 to permit opposite ends 26 of sheet 16 to wrap around pipe 12 and be drawn together in an overlapping relationship by a slide fastener or zipper 28, one half of which is dielectrically sealed to each of the opposite ends 26 of sheet 16 in order to suspend bag 10 from pipe 12 and seal it around the pipe 12 by forming arm-hole-like openings at side regions 24. One side of closure zipper 28 may be attached to its respective sheet 16 end 26 approximately two to four inches from the end 26 edge so that a tuck-in sealing flap extends under the zipper 28 and the opposite end 26 to provide better sealing. Strap holder loops 30 are formed along the edges 20 of bag 10 which immediately underlie pipe 12 when the bag 10 is in place. Each such loop 30 may receive a strap 31 to encircle the pipe and cinch or seal bag edges 24 tightly against the pipe in order to insure a good fit.

Arm and hand access ports 32 in the front 34 of the bag are fitted with sleeve and glove-shaped plastic film tubes 36 to allow access to the upper chamber 38 of the containment bag 10. Conveniently opposite the arm access ports 32 is a small rectangular tool sleeve 40 formed by attaching a rectangle of plastic film 41 to the inside of back 42 along upper and lower rectangle 41 edges 43 and 45 to form a sleeve open at both ends. Attachment may be accomplished using dielectric bonds, and the lower edge 45 may be bonded with sloping bond lines 47 and 49 which permit water and other waste materials to drain automatically from the sleeve 40. Valved ports 44 are located on the bag front 34 adjacent the arm access ports 32. The valved ports 44 allow insertion of spray hoses and HEPA filter vacuum hoses into the bag 10. Certain abatement techniques include pre-removal wetting of the asbestos covering, as well as post-removal wetting down of the bag 10 interior to cleanse the area of remaining asbestos fibers. Use of HEPA filter vacuums can assist the removal process by creating a negative air pressure in the containment bag.

A gusset-mounted slide fastener assembly 46 is dielectrically sealed to the front 34 and back 42 horizontally to divide the bag 10 into an upper chamber 38 containing all of the ports 32 and 44 and tool pouch flap 40 and lower chamber 48 for receiving asbestos 14 and other waste materials.

Figure 2:
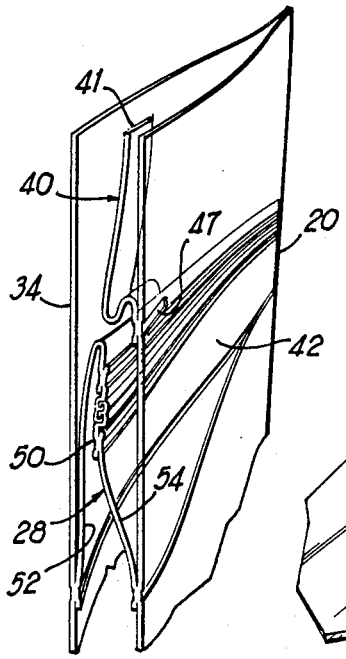
FIG. 2 is a cross section and perspective view of the gusset-mounted slide fastener assembly of the present invention.
Figure 3:
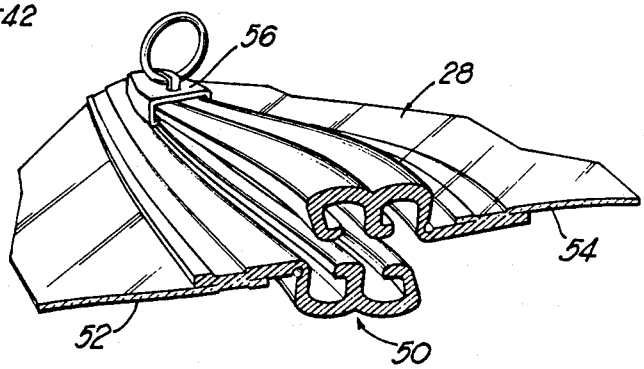
FIG. 3 is a further enlarged sectional and perspective view of the slide fastener assembly.

Slide fastener assembly 46 includes a slide fastener strip 50 (shown in section in FIG. 3) attached to gussets 52 and 54. Slide fastener 50 may be a Maxigrip No. 20 available from Minigrip, Inc. of Orangeburg, N.Y., which is conventionally operated with a metal slide 56. Each gusset 52 and 54 is a strip of plastic film attached along its edge to one side of slide fastener 50. Gusset 52 is wider than gusset 54 so that the gusset assembly 46 may lie flat when gusset edges 58 and 60 are attached along adjacent horizontal lines on the bag front 34 and back 42 as illustrated in FIG. 2. The described structure allows the fastener assembly 46 to lie flat when the bag 10 is folded for shipment or storage. As illustrated in FIG. 1, it also permits the lower chamber 48 to expand to accommodate a large quantity of asbestos waste 14 while retaining the ability to seal that chamber 48 by closing slide fastener 50 without unduly restricting the working space within upper chamber 38.

The present invention may be constructed using 10 mil thick, 2-ply flexible polyvinyl chloride ("PVC") clear sheet stock for the containment bag 10 and 8 mil flexible PVC for the tool sleeve 40 and gloves 36. All edges should be dielectrically sealed and water tight. The tool sleeve 40 can be tinted to provide greater visibility to assist workers placing tools in the pouch.

The fastener assembly 46 provides significant advances in the technology of hazardous waste abatement and overcomes some of the shortcomings and unsafe features in earlier versions of containment bags. The fundamental goal of asbestos abatement is to prevent aeration of asbestos fibers. Existing prior containment bags require the worker using the bag to tie off or close with hook and loop fasteners the filled portion of the bag when removal of asbestos from a pipe section is complete. The dynamics of such an action can necessarily force fiber-laden air back out of the bag and into its upper chamber. Thus, whether tied off prior to movement along a section of pipe or tied off after the bag is full, there is a risk asbestos fibers will be forced out of the lower chamber and possibly into and out of the upper chamber. By contrast, the lower chamber 48 of the bag 10 of the present invention can be quickly, conveniently and easily sealed using slide fastener 50 with less risk of forcing fibers into upper chamber 38.

Closing a conventional bag by gathering and tying or taping the upper portions or by engaging hook and loop fastener strips mounted on the bag front and back can significantly reduce the bag volume. Again, by contrast, the fastener assembly 46 of the present invention permits more efficient use of containment space within the bag 10 than is possible when the upper portion of a similar bag is gathered to seal it in conventional practice. More asbestos waste can be loaded into the bag, thus reducing the number of bags needed to complete a particular abatement project. Moreover, it is substantially more feasible utilizing the slide fastener 50 containing bag 10 of the present invention than with conventional bags safely and quickly to remove asbestos from a section of pipe 12, seal the waste-containing lower chamber 48, move to another section of pipe 12, open the chamber 48, and deposit additional asbestos 14 in it.

By reference to the above detailed description of the invention, those skilled in the art will have no difficulty in making changes and modifications in the individual parts or their relative assembly in order to meet specific requirements or conditions. Such changes and modifications may be made without departing from the scope and spirit of the invention, as set forth in the following claims. In particular, those having ordinary skill in the art will understand that bag 10 structures with differently oriented members will be required for use on vertical, T-shaped, valve-containing or other pipe 12 sections which are not straight horizontal sections like that illustrated in FIG. 1.

I claim:

1. A hazardous waste containment bag for use in removing waste from a pipe, comprising:

(a) a section of plastic film configured to form a container having an interior and an opening defined by free film edges, (b) a slide fastener assembly comprising a first slide fastener attached to plastic film gussets affixed to the film section within the interior to divide the container into waste-receiving and workspace chambers, the assembly having sufficient width to avoid significantly drawing the film section together when the waste-receiving chamber contains waste and the first slide fastener is closed, and the gussets being of different widths so that the slide fastener assembly may lie flat when the waste-receiving chamber is empty.

(c) at least one glove and sleeve appliance mounted in the film section to provide access to the workspace chamber, (d) a second slide fastener attached to portions of the free film edges for drawing such edges together in order to surround a portion of the pipe and close the container opening, and (e) at least one loop attached to the film to receive a strap for cinching the film snugly around the pipe.

2. A disposable hazardous waste containment bag for use in removing asbestos from a pipe, comprising:

(a) a generally rectangular section of polyvinyl chloride sheet folded along its center line and dielectrically sealed along side edges to form a container having front and back panels and an opening defined by juxtaposed panel ends and adjacent non-sealed side edges, (b) a first two-piece slide fastener, one piece of which is attached to each of the panel ends so that such ends may be drawn together to encircle a section of the pipe which protrudes through sleeves formed by the non-sealed edges, (c) two polyvinyl chloride glove and sleeve-shaped closed tubes mounted in the front panel, (d) a second two-piece slide fastener, one piece of which is attached to a first polyvinyl chloride sheet gusset extending between the side edges and affixed to the front panel and the other piece of which is attached to a second polyvinyl chloride sheet gusset extending between the side edges and affixed to the back panel so that a waste-receiving portion of the container may be sealed and separated from the remainder of the container by closing the second slide fastener, the gussets having sufficient width that closing the second slide fastener does not significantly draw the front and back panels together when the waste-receiving portion of the container contains waste, and one of the gussets being wider than the other gusset so that the gussets and slide fastener may lie flat when the waste-receiving portion of the container is empty.

3. A bag in accordance with claim 2, further comprising a second generally rectangular section of polyvinyl chloride sheet affixed to the inside of the back panel along the top and bottom edges of the second section to provide a sleeve for receiving tools.

4. A bag in accordance with claim 3, wherein the second panel is affixed along its bottom edge by two seal lines which slope when the bag is in use so that water and waste will drain out of the sleeve.

5. A bag in accordance with claim 2, further comprising at least one loop affixed to the section of sheet to receive a strap for cinching a portion of the sheet snugly around the pipe.

* * * * *